US006970658B2

(12) United States Patent
Furukawa

(10) Patent No.: US 6,970,658 B2
(45) **Date of Patent: *Nov. 29, 2005**

(54) FIXING APPARATUS FOR FIXING A TONER IMAGE ONTO A PAPER SHEET

(75) Inventor: Kimiaki Furukawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/936,811

(22) Filed: Sep. 9, 2004

(65) Prior Publication Data

US 2005/0031388 A1 Feb. 10, 2005

Related U.S. Application Data

(63) Continuation of application No. 10/377,661, filed on Mar. 4, 2003, now Pat. No. 6,839,525.

(30) Foreign Application Priority Data

Mar. 29, 2002 (JP) ..... 2002-097791

(51) Int. Cl.[7] ..... G03G 15/20; G03G 15/00

(52) U.S. Cl. ..... 399/33; 399/22; 399/68; 399/322

(58) Field of Search ..... 399/21, 22, 33, 399/67, 68, 322, 323, 328, 329

(56) References Cited

U.S. PATENT DOCUMENTS

| | | | | |
|---|---|---|---|---|
| 4,525,058 | A | 6/1985 | Hirabayashi et al. | |
| 5,365,322 | A | 11/1994 | Hamada et al. | |
| 6,091,926 | A | 7/2000 | Yamada | |
| 6,496,666 | B2 | 12/2002 | Hayashi et al. | |
| 6,501,914 | B2 | 12/2002 | Yoshikawa | |
| 6,556,794 | B2 | 4/2003 | Miura | |
| 6,839,525 | B2 * | 1/2005 | Furukawa | 399/33 |

FOREIGN PATENT DOCUMENTS

| | | |
|---|---|---|
| JP | 4-254883 | 9/1992 |
| JP | 5-35133 | 2/1993 |
| JP | 2001-75391 A | 3/2001 |

* cited by examiner

*Primary Examiner*—Sandra L. Brase
(74) *Attorney, Agent, or Firm*—Foley & Lardner LLP

(57) ABSTRACT

A fixing apparatus comprises a fixing belt held by and wound around a heating roller and a fixing roller, a pressurizing roller held pressed against the fixing roller by way of the fixing belt so as to heat and put pressure on the toner image on a sheet of paper with the fixing roller, a releasing member that releases the sheet of paper adhering to the fixing belt from the fixing belt during the fixing process, and a guide body that guides the sheet of paper along the fixing belt and causes the sheet to stick to and be conveyed by the transfer belt, without being released by the releasing member, along the fixing belt, so as to release the sheet of paper at a position where the fixing belt is held by the heating roller with a small radius of curvature.

8 Claims, 6 Drawing Sheets

FIXING APPARATUS FOR FIXING A TONER IMAGE ONTO A PAPER SHEET

CROSS-REFERENCE TO RELATED APPLICATIONS

The present application is a continuation of U.S. application Ser. No. 10/377,661, filed Mar. 4, 2003 now U.S. Pat. No. 6,839,525, which claims priority of Japanese Patent Application No. 2002-097791, filed Mar. 29, 2002, the entire contents of which are incorporated herein by reference.

BACKGROUND OF THE INVENTION

1. Field of the Invention

This invention relates to a fixing apparatus used for fixing a toner image transferred onto a sheet of paper provided in an electrophotographic printing machine or the like.

2. Description of the Related Art

Fixing apparatuses of the above identified type normally comprise a fixing roller and a pressurizing roller held in contact with the fixing roller so as to apply pressure to it. The sheet of paper onto which a toner image has been transferred is then fed to the nip section defined between the fixing roller and the pressurizing roller. The toner image on the sheet of paper is fixed to the latter as the sheet passes through the nip section.

The fixing roller is provided in the inside thereof with a heater, which heats the fixing roller from inside. However, such a fixing roller is accompanied by a disadvantage that it takes much time for the inside heater to heat the fixing roller until the temperature of the outer surface of the roller reaches the level necessary for fixation.

Recently, there has been developed a fixing apparatus in which a heating roller is arranged at a position separated from the fixing roller so as to hold a thin heat transfer belt with the fixing roller. With such a fixing apparatus, heat generated by the heating roller is transferred to the outer surface of the fixing roller by way of the thin heat transfer belt so that the temperature of the outer surface of the fixing roller can be raised to the necessary level in a short period of time.

However, in a fixing apparatus comprising such a heat transfer belt, the sheet of paper, onto which a toner image has been transferred, may adhere to the heat transfer belt during the fixing operation. Therefore, such fixing apparatuses are provided with a release member, which releases the sheet of paper from the heat transfer belt.

However, when a high density image is transferred to an area of the sheet of paper located near the front end of the sheet as viewed in the moving direction of the sheet, a release error can easily occur if compared with a sheet of paper where a low density image is transferred to the same area. Then, the sheet of paper adheres to the fixing belt.

When the sheet of paper adheres to the fixing belt, it either completely sticks to the corresponding surface of the fixing belt or comes off by itself from the fixing belt at a location where the fixing belt held by the heating roller turns with a small radius of curvature and becomes retained in a space near the fixing belt.

However, as the sheet of paper is retained in such a space, it may not be found by the user, thus often remains there unnoticed. The sheet of paper that is left in such a space is then exposed to high temperatures for a long period of time, and eventually catches fire, which can in turn damage the fixing belt.

BRIEF SUMMARY OF THE INVENTION

In view of the above identified circumstances, it is therefore the object of the present invention to provide a fixing apparatus that reliably notifies the user of the fact that the object of fixation is not released from the heat transfer device of the apparatus whenever such a situation arises and makes the object of fixation easily releasable from the heat transfer device.

According to an aspect of the invention, there is provided a fixing apparatus comprising a fixing roller, a heating roller separated from and arranged opposite to the fixing roller, a heat transfer device held by the heating roller and the fixing roller so as to move round and transfer heat from the heating roller to the fixing roller, a pressurizing roller held in contact with the fixing roller under pressure by way of the heat transfer device so as to heat an object of fixation by means of the fixing roller and fix the object by putting pressure on it, a releasing device which releases the object of fixation adhering to the heat transfer device from the heat transfer device during the fixing process and a guide device which guides the object of fixation along the heat transfer device and causes the object to stick to and be conveyed by the heat transfer device without being released by the releasing device along the heat transfer device so as to release the object of fixation at a position where the heat transfer device is held by the heating roller with a small radius of curvature.

According to another aspect of the invention, there is provided a fixing apparatus comprising a fixing roller, a heating roller separated from and arranged opposite to the fixing roller, a heat transfer device held by the heating roller and the fixing roller so as to move round and transfer heat from the heating roller to the fixing roller, a pressurizing roller held in contact with the fixing roller under pressure by way of the heat transfer device so as to heat an object of fixation by means of the fixing roller and fix the object by putting pressure on it, a releasing device which releases the object of fixation adhering to the heat transfer device from the heat transfer device during the fixing process and a pushing device which pushes and causes the object of fixation to stick to and be conveyed by the heat transfer device without being released by the releasing device along the heat transfer device so as to release the object of fixation at a position where the heat transfer device is held by the heating roller with a small radius of curvature.

According to still another aspect of the invention, there is provided a fixing apparatus comprising a fixing roller, a heating roller separated from and arranged opposite to the fixing roller, a heat transfer device held by the heating roller and the fixing roller so as to move round and transfer heat from the heating roller to the fixing roller, a pressurizing roller held in contact with the fixing roller under pressure by way of the heat transfer device so as to heat an object of fixation by means of the fixing roller and fix the object by putting pressure on it, a first releasing device which releases the object of fixation adhering to the heat transfer device from the heat transfer device during the fixing process, a second releasing device which releases the object of fixation adhering to and being conveyed by the heat transfer device without being released by the first releasing device at a position where the heat transfer device is held by the heating roller with a small radius of curvature and a guide device which guides the object of fixation released by the second releasing device toward the outside.

According to a further aspect of the invention, there is provided a fixing apparatus comprising a fixing roller, a heating roller separated from and arranged opposite to the fixing roller, a heat transfer device held by the heating roller and the fixing roller so as to move round and transfer heat from the heating roller to the fixing roller, a pressurizing roller held in contact with the fixing roller under pressure by way of the heat transfer device so as to heat an object of fixation by means of the fixing roller and fix the object by putting pressure on it, a drive device which drives the heating roller, the fixing roller and the pressurizing roller to rotate, a releasing device which releases the object of fixation adhering to the heat transfer device from the heat transfer device during the fixing process, a judging device which judges if the object of fixation passed the nip section between the fixing roller and the pressurizing roller with a predetermined period of time or not and a control device which stops the drive operation of the drive device and causes the rear end side of the object of fixation to project from the nip section in the moving direction of the object of fixation when the judging device judges that the object of fixation did not pass the nip section within the predetermined period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will now be described by referring to the accompanying drawings that illustrate preferred embodiments of the invention.

Figure 1:
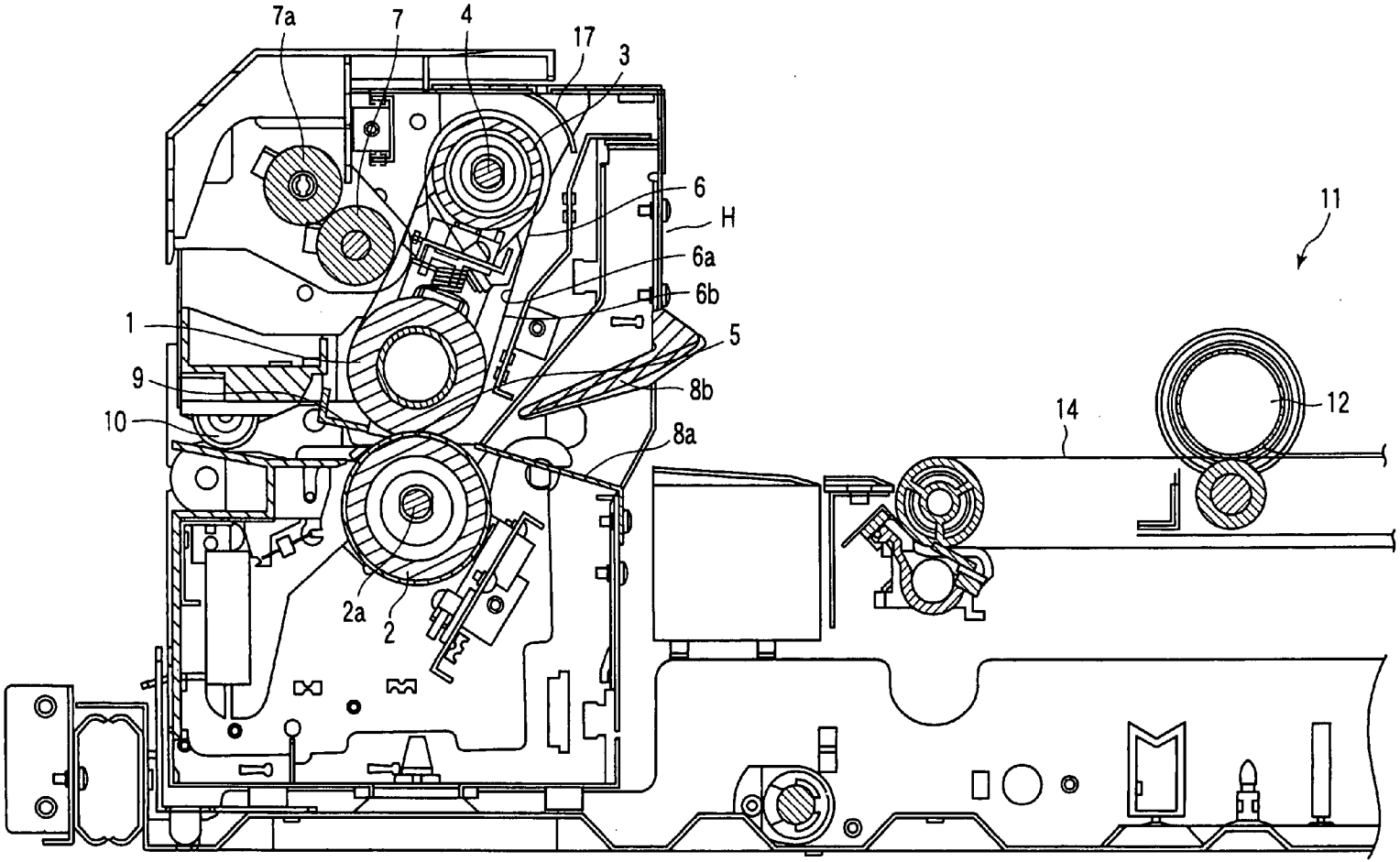
FIG. 1 is a cross sectional view of the first embodiment of fixing apparatus according to the invention, illustrating its configuration.

FIG. 1 is a cross sectional view of the first embodiment of a fixing apparatus according to the invention, illustrating its configuration.

The fixing apparatus can typically be used in an electrophotographic copying machine. It comprises a main body frame H and a fixing roller 1 which is an elastic roller arranged in the main body frame H. A pressurizing roller 2 is arranged under the fixing roller 1. The pressurizing roller 2 is also an elastic roller and has a higher hardness than that of the fixing roller 1. It contains a heater 2*a* in the inside, which may be a halogen lamp.

A heating roller 3 is arranged above the fixing roller 1. The heating roller 3 also contains a heater 4 in the inside, which may be a halogen lamp. The fixing roller 1, the pressurizing roller 2 and the heating roller 3 are rotatably supported by respective rotary shafts that extend in parallel with each other between the two side frame members of the main body frame H. A fixing belt 6 is wound around and held by the fixing roller 1 and the heating roller 3. It operates as a heat transfer device. The fixing belt 6 has a belt member 6*a* and a heat-resistant elastic releasing layer 6*b* covered on the outer surface of the belt member 6*a*.

The distance between the rotary shaft of the fixing roller 1 and that of the pressurizing roller 2 is slightly smaller than the sum of the radii of the fixing roller 1 and that of the pressurizing roller 2. Therefore, the fixing roller 1 and the pressurizing roller 2 press each other to produce a nip section 5 between them and the fixing roller 1 is slightly depressed by the pressurizing roller 2.

An oil applicator roller 7 is held in contact with the outer surface of the fixing belt 6. The oil applicator roller 7 is pressed against the fixing belt 6 and adapted to apply silicon oil to and, at the same time, clean the outer surface of the fixing belt 6. The oil applicator roller 7 is pressed against the fixing belt 6 so that the latter is subject to a predetermined level of tension. A cleaner 7*a* is rotatably held in contact with the oil applicator roller 7.

Guide bodies 8*a* and 8*b* are arranged in the nip section 5 defined by the fixing roller 1 and the pressurizing roller 2 at the sheet of paper receiving side thereof. They are adapted to guide a sheet of paper P, or an object of fixation. A releasing member (first releasing device) 9 is arranged at the sheet of paper delivery side of the fixing roller 1 in order to release the sheet of paper P adhering to the fixing belt 6. A discharging roller 10 is arranged at the downstream side of the nip section 5 to discharge the sheet of paper P.

On the other hand, an image forming section 11 is arranged at the upstream side of the fixing apparatus for delivering the sheet of paper P. The image forming section 11 includes a plurality of photosensitive drums 12 (only one of which is shown) arranged in series for delivering the sheet of paper P. Toner images of cyan, magenta, yellow and black are to be formed respectively on the photosensitive drums 12. The toner images of the different colors formed on the respective photosensitive drums 12 are transferred onto the sheet of paper P to produce a color image.

The sheet of paper P onto which the toner images are transferred is then conveyed toward the fixing device by conveyor belt 14 so that it eventually enters and passes through the nip section 5 between fixing roller 1 and the pressurizing roller 2 as they are guided by the guide bodies 8*a*, 8*b*. As the sheet of paper P passes through the nip section 5, it is heated and pressurized to fix the transferred toner images, i.e., the color toner image. After the fixing process, the sheet of paper P is delivered to the outside by the discharging roller 10.

During the fixing process, the sheet of paper P may adhere to the fixing belt 6 but the sheet of paper P adhering to the fixing belt 6 will be released from the latter at the first release point P1 by the releasing member 9.

However, when a high density toner image is transferred to an area of the sheet of paper P located near the front end of the sheet as viewed in the moving direction of the sheet, the sheet of paper P may firmly adhere to the fixing belt 6. Then, the releasing member 9 may fail to release the sheet of paper P and the latter may be conveyed further, adhered to the fixing belt 6.

The sheet of paper P that is being conveyed further either completely sticks to the corresponding surface of the fixing belt 6 or comes off by itself from the fixing belt 6 at a location where the fixing belt 6 held by the heating roller 3 turns with a small radius of curvature (the second release point P2) and becomes retained in a space near the fixing belt 6.

As the sheet of paper P is retained in a space near the fixing belt 6, it is difficult to be found by the user, thus it stays there, and may be exposed to high temperatures for a long time, and could catch fire, damaging the fixing belt 6.

To avoid such a situation, this embodiment comprises a guide device, guide body 17, above the heating roller 3 at a position separated from the latter by a predetermined gap. The guide body 17 has a curved profile that corresponds to the curved surface of the heating roller 3 and is separated from the heating roller 3 by a gap to provide a space S between them that allows the sheet of paper P to pass through.

Figure 2:
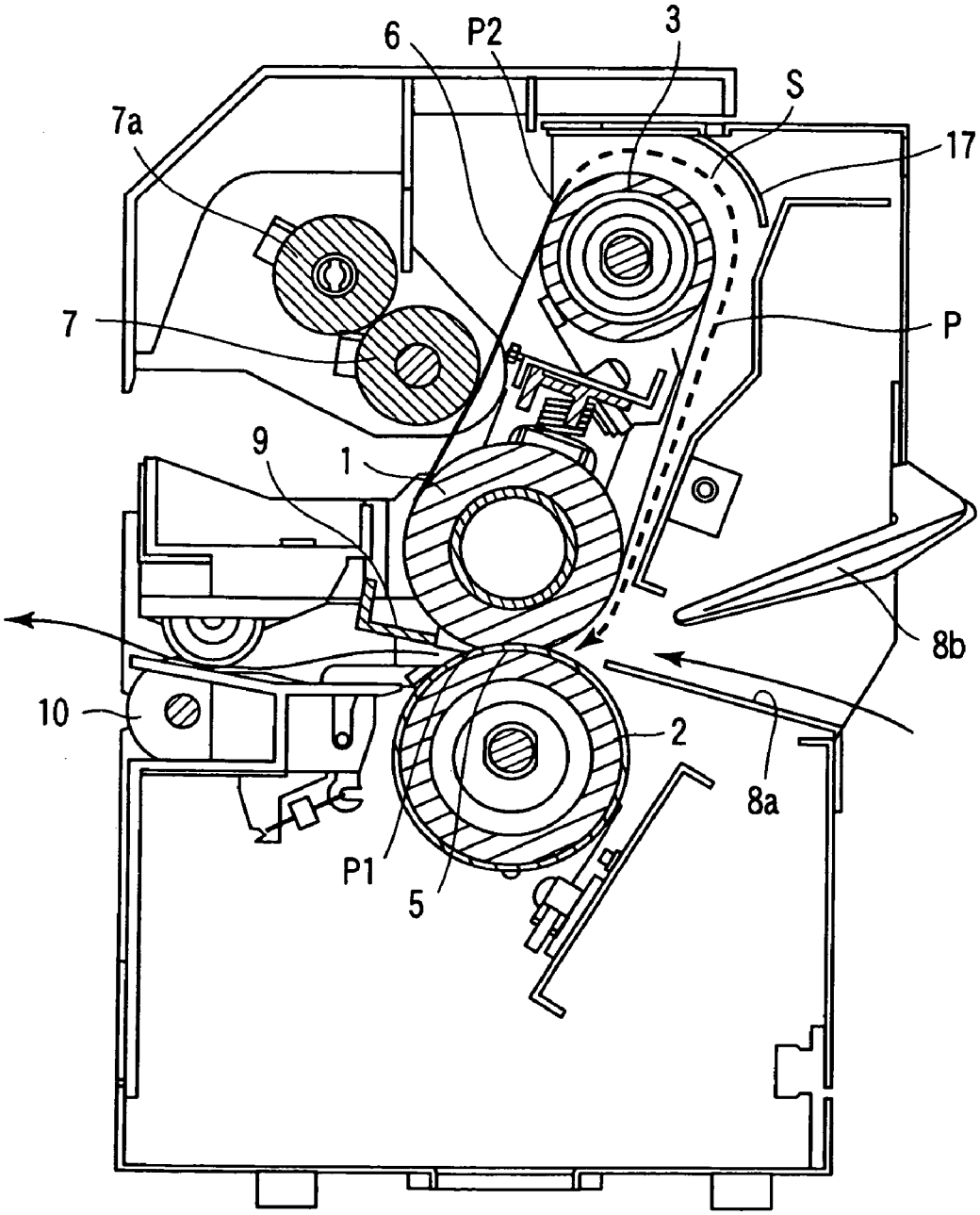
FIG. 2 is a cross sectional view of the fixing apparatus of FIG. 1, illustrating a sheet of paper adhering to the fixing belt.

As the sheet of paper P that is adhering to and conveyed by the fixing belt 6 is released from the latter at the second release point P2, it is guided by the guide body 17 and moves in the direction indicated by the dashed arrow shown in FIG. 2 and sticks to the fixing belt 6 again. Then, the sheet of paper P is conveyed to the nip section 5. Therefore, if the immediately succeeding sheet of paper P that carries a color toner image is fed into the nip section 5, the toner image cannot be fixed properly, which gives rise to a fixing failure.

Then, the sheet of paper P showing a fixing failure is discharged to the outside by way of the discharging roller 10 so that the user can see the sheet of paper P showing a fixing failure. Then, the user realizes that another sheet of paper P is retained in the space near the fixing belt 6, and removes the retained sheet of paper P.

In other words, this embodiment can reliably avoid a situation where a sheet of paper P that is left in the space and exposed to high temperatures for a long time eventually gives off smoke and catches fire, which in turn damages the fixing belt 6.

Figure 3:
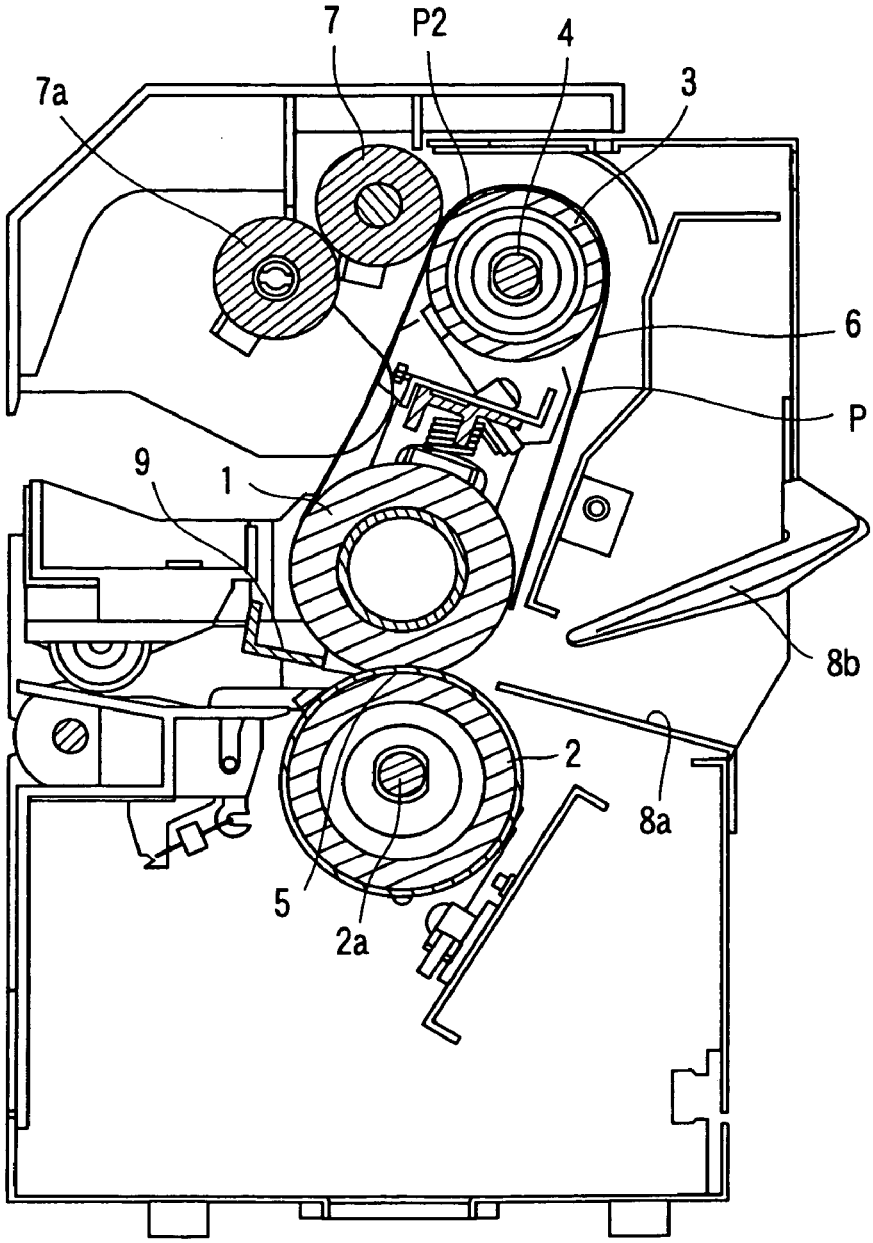
FIG. 3 is a cross sectional view of the second embodiment of fixing apparatus according to the invention, illustrating its configuration.

FIG. 3 is a cross sectional view of the second embodiment of a fixing apparatus according to the invention, illustrating its configuration.

The components of the second embodiment that are the same as their counterparts of the first embodiment are denoted respectively by the same reference symbols and will not be described any further.

In this second embodiment, the oil applicator roller 7 is arranged near the heating roller 3 and is adapted to operate as a pushing device. The oil applicator roller 7 pushes the heating roller 3 at the second release point P2.

With the second embodiment, the sheet of paper P that is to be released at the second release point P2 is pushed against the fixing belt 6 by the oil applicator roller 7. Therefore, the sheet of paper P completely sticks to the fixing belt 6 and is conveyed to the nip section 5.

Thus, as in the first embodiment, the immediately succeeding sheet of paper P showing a fixing failure is discharged to the outside by way of the discharging roller 10 so that the user can see the sheet of paper P showing a fixing failure. Then, the user realizes that another sheet of paper P is retained in the space near the fixing belt 6 and removes the retained sheet of paper P.

Figure 4:
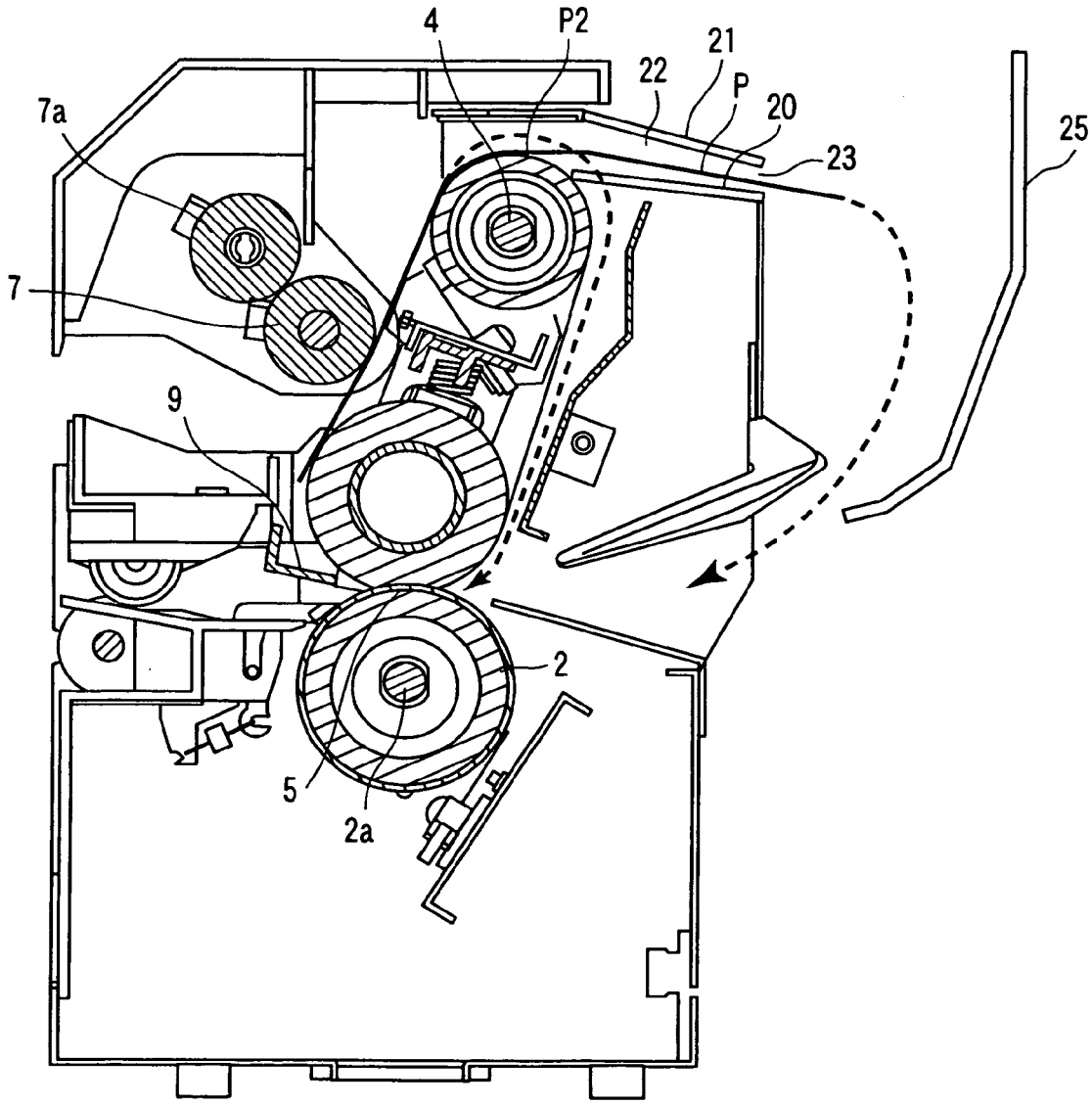
FIG. 4 is a cross sectional view of the third embodiment of fixing apparatus according to the invention, illustrating its configuration.

FIG. 4 is a cross sectional view of the third embodiment of fixing apparatus according to the invention, illustrating its configuration.

The components of the third embodiment that are the same as their counterparts of the first embodiment are denoted respectively by the same reference symbols and will not be described any further.

In this third embodiment, a second release member 20 is arranged near the second release point P2 and a guide plate 21 is arranged above the second release member 20 with a predetermined gap separating them from each other.

A sheet of paper delivery route 22 is formed between the second release member 20 and the guide plate 21, which opens out at opening 23 formed in the main body frame H.

An external guide body 25 is arranged outside the main body frame H at a position opposite to the opening 23 of the main body frame H. Therefore, the sheet of paper P discharged from the third embodiment through the opening 23 is guided downward by the external guide body 25.

With the third embodiment, the sheet of paper P that is adhering to and conveyed by the fixing belt 6 is released from the latter at the second release point P2 by the second release member 20. The released sheet of paper P is discharged to the outside by way of the delivery route 22 and through the opening 23 as indicated by one of the dashed arrows in FIG. 4. The discharged sheet of paper P is then conveyed back to the nip section 5 as it is guided downward by the external guide body 25 as indicated by the other arrow in FIG. 4. Therefore, the user can see and remove the sheet of paper P conveyed back to the nip section 5.

Figure 5:
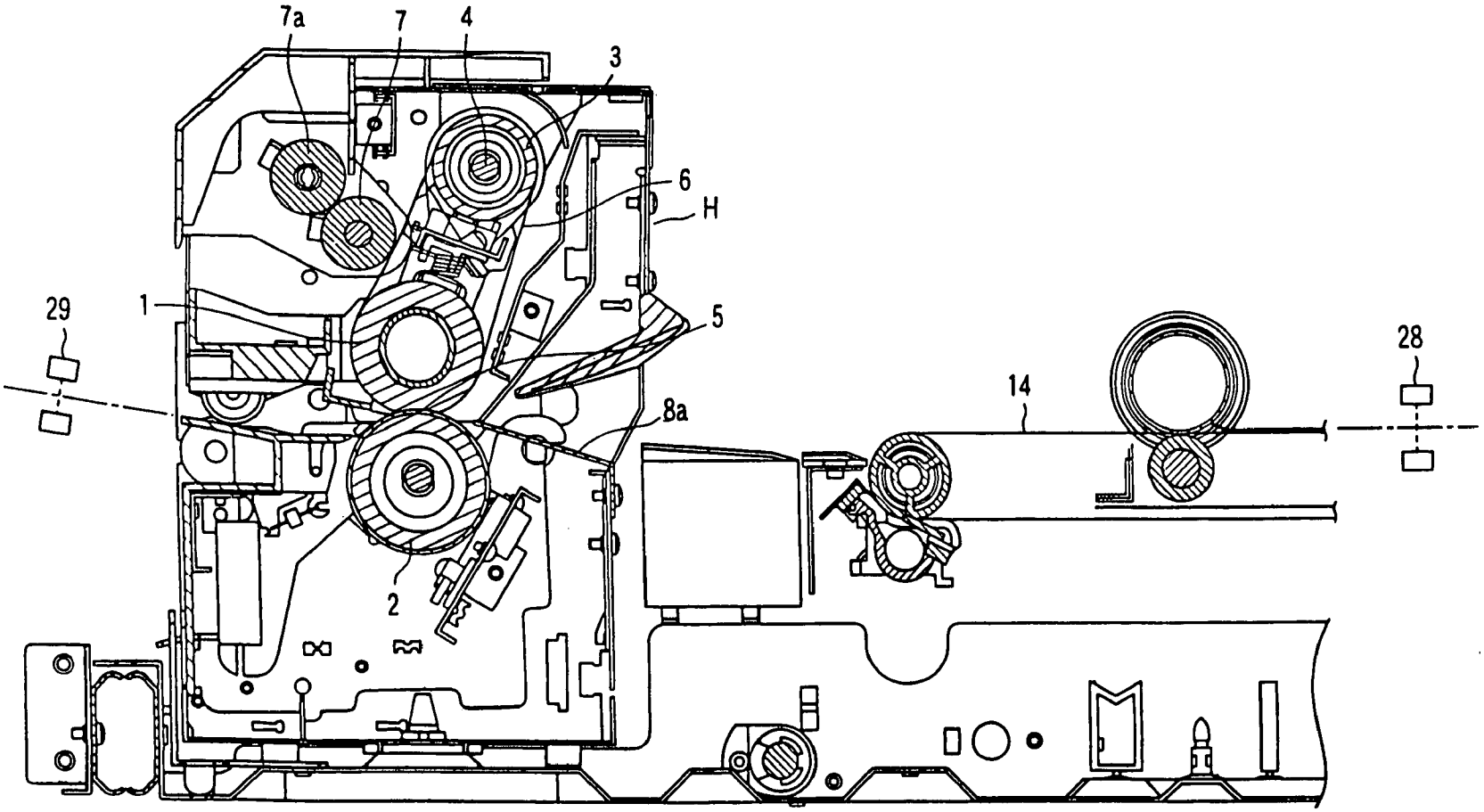
FIG. 5 is a cross sectional view of the fourth embodiment of fixing apparatus according to the invention, illustrating its configuration.

FIG. 5 is a cross sectional view of the fourth embodiment of a fixing apparatus according to the invention, illustrating its configuration.

The components of the fourth embodiment that are same as their counterparts of the first embodiment are denoted respectively by the same reference symbols and will not be described any further.

In this fourth embodiment, a start sensor 28, which is the first object of fixation sensor, is arranged upstream, in respect of conveyance of a sheet of paper in the fixing apparatus, and an arrival sensor 29, which is the second object of fixation sensor, and which is arranged on the downstream side in the fixing apparatus.

The sheet of paper P that is being conveyed by the conveyor belt 14 is detected by the start sensor 28 and then fed to the nip section 5 between the fixing roller 1 and the pressurizing roller 2 of the fixing apparatus. After passing through the nip section 5, the sheet of paper P is detected by the arrival sensor 29.

While sheets of paper of various sizes may be fed to the nip section 5 between the fixing roller 1 and the pressurizing roller 2 of this embodiment, the distance between the nip section 5 and the arrival sensor 29 is made smaller than the length of a sheet of paper P of the smallest size as viewed in the moving direction of the sheet. Therefore, the sheet of paper P that has passed through the nip section 5 is reliably detected by the arrival sensor 29 even if the sheet of paper P is of the smallest size.

If the sheet of paper P that has been detected by the start sensor 28 is not detected by the arrival sensor 29 within a predetermined period of time, the rear end side of the sheet of paper P projects backwards from the nip section 5, without passing through the nip section 5.

Figure 6:
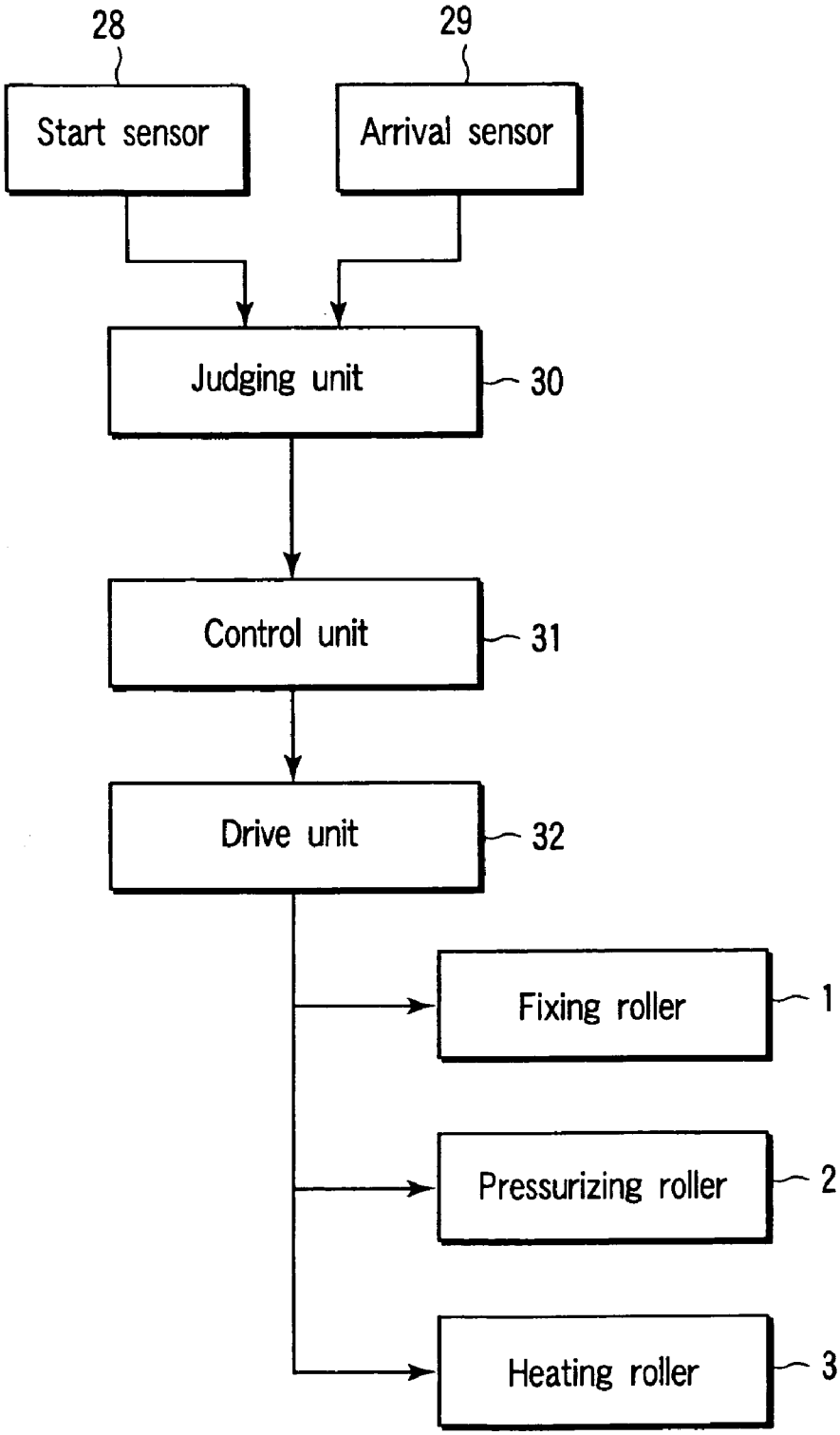
FIG. 6 is a block diagram of the drive control system of the embodiment of fixing apparatus of FIG. 5.

The start sensor 28 and the arrival sensor 29 are connected to a judging unit 30, or judging device, as shown in FIG. 6 by way of respective signal circuits. The judging unit 30 is connected to a control unit 31, or control device, by way of a transmission circuit, and the control unit 31 is connected to a drive unit 32 by way of a control circuit. The drive unit 32 drives the fixing roller 1, the pressurizing roller 2 and the heating roller 3 to rotate.

As the sheet of paper P being conveyed is detected by the start sensor 28, a corresponding detection signal is transmitted to the judging device 30. As the front end of the sheet of paper P is detected by the arrival sensor 29, a corresponding detection signal is also transmitted to the judging device 30.

The judging unit 30 judges that the sheet of paper P that is detected by the start sensor 28 does not pass through the nip section 5 within a predetermined period of time if it does not receive a detection signal from the arrival sensor 29 after the elapse of the predetermined period of time since the reception of a corresponding detection signal from the start sensor 28.

If the judging unit 30 judges so, the control unit 31 stops the operation of the drive unit 32 to stop the rotary motions of the fixing roller 1, the pressurizing roller 2 and the heating roller 3.

As a result, the sheet of paper P stops with its rear end projecting backwards from the nip section 5.

Therefore, the user who sees the rear end side of the sheet of paper P can easily remove the sheet of paper P from the nip section 5 by pulling it out.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing roller;

a heating roller separated from and arranged opposite to the fixing roller;

a heat transfer device held by the heating roller and the fixing roller so as to move round and transfer heat from the heating roller to the fixing roller;

a pressurizing roller held in contact with the fixing roller under pressure by way of the heat transfer device so as to heat an object of fixation by means of the fixing roller and fix the object by putting pressure on it;

a drive device that drives the heating roller, the fixing roller and the pressurizing roller to rotate;

a releasing device that releases the object of fixation adhering to the heat transfer device from the heat transfer device during the fixing process;

a judging device that judges if the object of fixation has passed the nip section between the fixing roller and the pressurizing roller within a predetermined period of time or not;

a control device that stops the drive operation of the drive device and causes the rear end side of the object of fixation to project from the nip section in the moving direction of the object of fixation when the judging device judges that the object of fixation did not pass the nip section within the predetermined period of time; and a guide device that guides the object of fixation along the heat transfer device and causes the object to stick to and be conveyed by the heat transfer device without being released by the releasing device along the heat transfer device so as to release the object of fixation at a position where the heat transfer device is held by the heating roller with a small radius of curvature.

2. The apparatus according to claim 1, wherein the heating roller has a heat source in the inside thereof.

3. The apparatus according to claim 1, wherein the heat transfer device has a belt base member and a heat-resistant elastic releasing layer formed on the outer surface of the belt base member by coating.

4. The apparatus according to claim 1, wherein the judging device includes a first sensor arranged upstream and a second sensor arranged downstream as viewed in the moving direction of the object of fixation between the fixing roller and the pressurizing roller.

5. The apparatus according to claim 4, wherein objects of fixation of various sizes can be fed to the nip section between the fixing roller and the pressurizing roller and the distance between the nip section and the second sensor is made smaller than the length of an object of fixation of the smallest size as viewed in the moving direction of the object of fixation.

6. A fixing apparatus comprising:

a fixing roller;

a heating roller separated from and arranged opposite to the fixing roller;

a heat transfer device held by the heating roller and the fixing roller so as to move round and transfer heat from the heating roller to the fixing roller;

a pressurizing roller held in contact with the fixing roller under pressure by way of the heat transfer device so as to heat an object of fixation by means of the fixing roller and fix the object by putting pressure on it;

a drive device that drives the heating roller, the fixing roller and the pressurizing roller to rotate;

a releasing device that releases the object of fixation adhering to the heat transfer device from the heat transfer device during the fixing process;

a judging device that judges if the object of fixation has passed the nip section between the fixing roller and the pressurizing roller within a predetermined period of time or not;

a control device that stops the drive operation of the drive device and causes the rear end side of the object of fixation to project from the nip section in the moving direction of the object of fixation when the judging device judges that the object of fixation did not pass the nip section within the predetermined period of time; and a pushing device that pushes and causes the object of fixation to stick to and be conveyed by the heat transfer device without being released by the releasing device along the heat transfer device so as to release the object of fixation at a position where the heat transfer device is held by the heating roller with a small radius of curvature.

7. The apparatus according to claim 6, wherein the pushing device is a pushing roller that also operates as a cleaning roller for cleaning the heat transfer device.

8. A fixing apparatus comprising:

a fixing roller;

a heating roller separated from and arranged opposite to the fixing roller;

a heat transfer device held by the heating roller and the fixing roller so as to move round and transfer heat from the heating roller to the fixing roller;

a pressurizing roller held in contact with the fixing roller under pressure by way of the heat transfer device so as to heat an object of fixation by means of the fixing roller and fix the object by putting pressure on it;

a drive device that drives the heating roller, the fixing roller and the pressurizing roller to rotate;

a first releasing device that releases the object of fixation adhering to the heat transfer device from the heat transfer device during the fixing process;

a judging device that judges if the object of fixation has passed the nip section between the fixing roller and the pressurizing roller within a predetermined period of time or not;

a control device that stops the drive operation of the drive device and causes the rear end side of the object of fixation to project from the nip section in the moving direction of the object of fixation when the judging device judges that the object of fixation did not pass the nip section within the predetermined period of time;

a second releasing device that releases the object of fixation adhering to and being conveyed by the heat transfer device without being released by the first releasing device at a position where the heat transfer device is held by the heating roller with a small radius of curvature; and a guide device that guides the object of fixation released by the second releasing device towards the outside.

* * * * *